US006500106B1

(12) United States Patent
Fulks

(10) Patent No.: US 6,500,106 B1
(45) **Date of Patent: *Dec. 31, 2002**

(54) METHOD AND APPARATUS FOR MECHANICAL EMULATION OF DUMBBELLS

(76) Inventor: Kent Fulks, 9710 Amberly Dr., Dallas, TX (US) 75243

( * ) Notice: Subject to any disclaimer, the term of this patent is extended or adjusted under 35 U.S.C. 154(b) by 0 days.

This patent is subject to a terminal disclaimer.

(21) Appl. No.: 09/442,040

(22) Filed: Nov. 17, 1999

Related U.S. Application Data

(63) Continuation-in-part of application No. 09/095,360, filed on Jun. 10, 1998, which is a continuation-in-part of application No. 08/667,428, filed on Jun. 21, 1996, now Pat. No. 5,769,757.

(51) Int. Cl.[7] ..... A63B 21/078; A63B 21/08
(52) U.S. Cl. ..... 482/137; 482/97
(58) Field of Search ..... 482/92, 97, 100–103, 482/135–139, 142

(56) References Cited

U.S. PATENT DOCUMENTS

| | | | | | |
|---|---|---|---|---|---|
| 4,411,424 | A | * | 10/1983 | Barnett | 482/139 |
| 5,336,148 | A | | 8/1994 | Ish, III | 482/98 |
| 5,342,270 | A | | 8/1994 | Jones | 482/98 |
| 5,413,546 | A | * | 5/1995 | Basile | 482/99 |
| 5,417,633 | A | * | 5/1995 | Habing | 482/97 |
| 5,486,150 | A | | 1/1996 | Randolph | 482/133 |
| 5,562,577 | A | | 10/1996 | Nichols, Sr. et al. | 482/97 |
| 5,643,152 | A | * | 7/1997 | Simonson | 482/100 |
| 5,683,334 | A | * | 11/1997 | Webber | 482/100 |
| 5,707,323 | A | * | 1/1998 | Simonson | 482/97 |
| 5,769,757 | A | * | 6/1998 | Fulks | 482/45 |
| 5,810,701 | A | * | 9/1998 | Ellis et al. | 482/136 |
| 5,897,467 | A | * | 4/1999 | Habing et al. | 482/100 |
| 6,056,678 | A | * | 5/2000 | Giannelli et al. | 482/137 |
| 6,174,265 | B1 | * | 1/2001 | Alessandri | 482/5 |
| D439,941 | S | * | 4/2001 | Batca et al. | D21/676 |
| D440,610 | S | * | 4/2001 | Webber et al. | D21/675 |

FOREIGN PATENT DOCUMENTS

| | | | | | |
|---|---|---|---|---|---|
| AU | 653426 | B | * | 3/1993 | 482/92 |
| FR | 2612406 | A1 | * | 9/1988 | 482/100 |

OTHER PUBLICATIONS

"Swivel Grip", brochure received in USPTO Jun. 9, 1994, 482/139.*

* cited by examiner

*Primary Examiner*—Glenn E. Richmon
*Assistant Examiner*—Victor Hwang
(74) *Attorney, Agent, or Firm*—John F. Bryan

(57) ABSTRACT

Apparatus for exercising the forearms and upper arms, in the manner of dumbbells, has a frame with a horizontal pivotal axis, A1, at least one lever having the proximal end connected for pivotal movement about axis A1, a handle extension connected to the distal end of the lever for pivotal movement about an axis A2, A2 being substantially perpendicular to A1, a connecting linkage for pivoting the handle extension about axis A2 in a predetermined relationship relative to the lever as the lever pivots about axis A1, and a handle having a longitudinal axis substantially parallel to axis A2, a gripping end centered on, and perpendicular to the longitudinal axis, and an opposite end, pivotally connected to the handle extension at the distal end thereof for free rotation about the longitudinal axis, so as to permit elective pronation and supination movements of the hands in combination with converging and diverging arm movements.

5 Claims, 9 Drawing Sheets

280
282
267
285
286
288
289
290
292
263
262
268
252
284
A9
A8
259
258
256

METHOD AND APPARATUS FOR MECHANICAL EMULATION OF DUMBBELLS

This is a continuation-in-part of application Ser. No. 09/095,360 filed on Jun. 10, 1998, which is a continuation-in-part of application Ser. No. 08/667,428 filed on Jun. 21, 1996 and issued as U.S. Pat. No. 5,769,757.

TECHNICAL FIELD

This invention relates generally to exercise machines and more particularly to exercise machines with forced pronation or supination movement for the hands and arms.

BACKGROUND OF THE INVENTION

Many athletes and non-athletes utilize weight lifting or weight training exercises to build strength and/or bulk, or to improve overall condition and appearance. Typically, weight training exercises are performed with either exercise machines or free weights, i.e, barbells with plates for incremental weight selection, dumbbells, etc. For various reasons, most exercise programs incorporate both machines and free weights in a variety of different exercise routines in order to maximize the effect of working specific muscle groups.

Free weights offer a number of advantages over exercise machines. For instance, they are relatively inexpensive in comparison to exercise machines. Free weights are also more versatile because a variety of exercises can be performed with one set of weights, whereas most exercise machines are designed for only one exercise. Even though some exercise machines accommodate more than one exercise, the cost of these machines usually increases proportionately with the number of exercises. Use of dumbbells also enables both arms to be exercised independently. Finally, dumbells are popular among many weight lifters because the lifting movements rather than being restricted to prescribed planes of motion can follow a more natural converging/diverging path.

Nevertheless, there are inherent disadvantages associated with free weights. One such disadvantage relates to safety. Most weight room instructors strongly advise against an individual working out alone, and this cautionary measure is particularly important when lifting free weights, because becoming trapped beneath a bar could easily occur in exercises such as bench press, incline or squat. There is also the danger of dropping a weight so as to cause personal injury. Also loading and unloading of heavy plates onto the ends of a bar can sometimes, through carelessness, result in an unbalanced bar that falls from its rack.

Another disadvantage associated with free weights relates to the fact that the weight resistance, or opposing force, that is exercised against is always directed vertically downward by gravity. Yet, the moment arm of the weight about the pivot point varies considerably throughout the full range of motion. This principle is explained in U.S. Pat. No. 3,998,454 with respect to a commonly performed exercise referred to as the dumbbell biceps curl. In short, during this exercise the applied moment arm about the elbow varies according to the sine of the angle of the lower arm with respect to the vertically oriented upper arm. The moment arm is greatest when the angle is 90° and it is lowest when the angle is 180° and 0°.

If the resistance capabilities of the muscles of the human body matched this moment arm, the degree of difficulty experienced by the exerciser would be uniform, or balanced, throughout the entire range of motion. However, as reported in U.S. Pat. No. 3,998,454, the strength generated by the human muscles during this exercise is not in fact "balanced" throughout the range of motion, and there are some "sticking points" of increased difficulty. As a result, maximum benefits are not achieved when performing a biceps curl with a dumbbell.

The pullover machine disclosed in U.S. Pat. No. 3,998,454 utilizes an eccentric cam to vary weight resistance over the range of motion for the muscles utilized in a pullover maneuver. Over the years, for various muscle groups, a number of these cam and chain machines have been designed in an attempt to match a resistance variation through a range of motion with the natural strength curve for a particular muscle group associated with the range of motion. An improvement over the use of free weights has been achieved, according to the extent that these machines succeed in varying the exercise resistance to match an appropriate strength curve.

Some exercise devices in the prior art allow the handles gripped by the user to pivot freely while moving through the range of motion for an exercise. Some others, specifically Fulks U.S. Pat. No. 5,769,757, force a supination or pronation movement in the hands and forearms. There are however, no existing exercise machines that truly emulate the feel and effect of exercising with dumbbells.

Therefore, the object of the present inventions is to provide exercise machines with the safety not inherent to the use of free weights, while emulating the feel and effect of exercising with dumbbells. A second object is that the exercise machines of the present invention be configured to guide lifting movements along a natural, converging or diverging path, while permitting natural pronation or supination movements. A third object of the present inventions is to provide the aforementioned characteristics together with a capability for varying the exercise resistance to match an appropriate strength curve.

SUMMARY OF THE INVENTION

In accordance with a preferred embodiment of the present inventions, herein is disclosed an exercise device with free pronation or supination movement of the hands and arms in conjunction with the standard range of motion for a specified exercise. The device comprises a base frame and a centrally mounted seat. The seat is bisected by a vertical plane that extends through the middle of the frame so that the device has two sides that are mirror images with respect to the vertical mid-plane.

A pair of levers are pivotally attached to the frame for rotation about an axis A1. In an embodiment configured for use in "bench" pressing or rowing type exercises, the user sits above axis A1 and the levers extend in a generally upward direction. A member may be attached between the levers so as to require the levers to pivot in tandem about an axis of rotation A1 or, in another embodiment, the levers may be mounted to pivot separately.

Pivotally connected to the distal end of each lever is a handle extension. This connection allows pivotal movement of the handle extension about a second axis of rotation A2 oriented in a substantially perpendicular relationship to axis A1.

An off-set linkage rod connected between the handle extension and the frame by means of ball and socket connectors causes the handle extensions to rotate about axes A2 so as to converge and diverge as the levers rotate about axis A1. Handles are pivotally mounted at the distal end of each handle extension, with each of the pivotal axes A3 lying substantially in a plane defined by the associated axis A2 and the longitudinal centerline of the handle extension. The handles are free to rotate about axes A3 so as to allow natural pronation and supination throughout the range of movement. Thus, doing a given exercise on a device embodying the present inventions has much the same feel and is functionally equivalent to the same exercise with dumb bells.

In operation, as force is applied by the exerciser to the handles, the levers (of a press machine) pivot forward about axis A1. As the levers pivot about axis A1, the handle extensions are forced to pivot in a predetermined fixed relationship about axis A2 so as to converge. The hand and forearm of the exerciser would undergo a pronation movement except that the grip handle is allowed to pivot about axis A3 as the lever is pivoted about the axis A1. The hand and forearm move forward and inward, along a converging path, as the lever is pivoted, but pronate or supinate only as desired by, or comfortable to, the exerciser.

An alternate embodiment, as might be used for a curling machine, is basically the same in principle, except that axis A1 is preferably located behind the user's back and the lever and handle extension members extend more or less horizontally from axis A1 on either side of the user.

BRIEF DESCRIPTION OF THE DRAWINGS

The accompanying drawings are incorporated into and form a part of the specification to assist in explaining the present inventions. The drawings illustrate preferred and alternative examples of how the inventions can be made and used and are not to be construed as limiting the inventions to only those examples illustrated and described. The various advantages and features of the present inventions will be apparent from a consideration of the drawings in which.

DETAILED DESCRIPTION OF THE DRAWINGS

Figure 1:
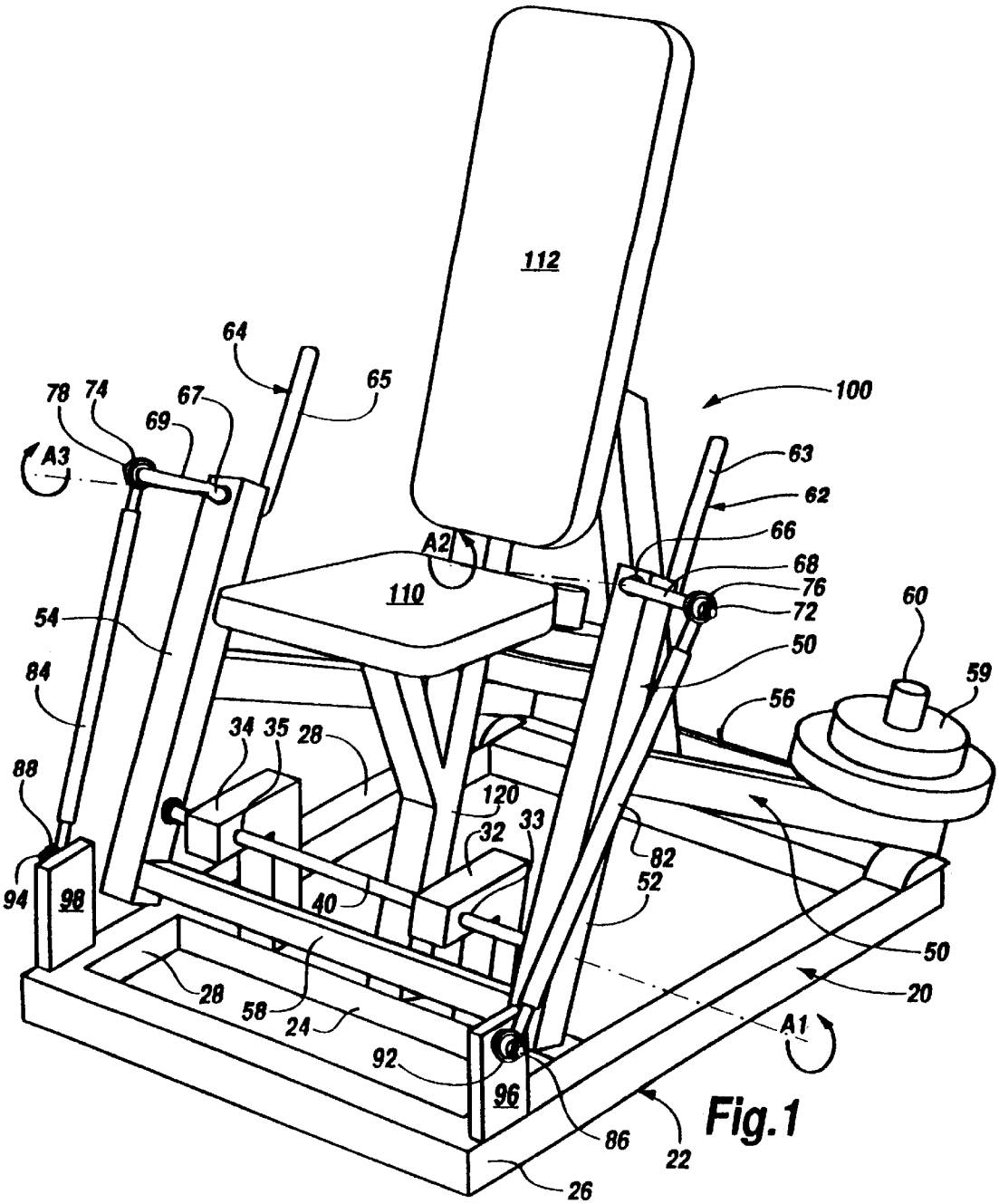
FIG. 1 is a perspective view of an exercise machine comprising the first embodiment of the present invention.

The present inventions are described in the following by referring to drawings of examples of how the inventions can be made and used. In these drawings, reference characters are used throughout the views to indicate like or corresponding parts. FIGS. 1–15 illustrates some examples of exercise machine embodiments to which the present invention may be applied. The embodiments shown and described herein are exemplary. Many details are well known in the art, and as such are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad general meaning of the terms used in the attached claims.

Reference is now made to the drawings wherein like reference characters denote like or similar parts throughout the FIGS. 1–15 FIGURES. Referring to FIG. 1, therein is illustrated an exercise device 100. A seat 110 and a back 112 are bisected by a vertical plane that extends through the middle of a frame 20. The device 100 has two sides that are mirror images with respect to the vertical mid-plane.

The device 100 comprises a conventional frame 20 including a rectangular base 22 formed of standard metallic tubing, an intermediate cross brace 24 perpendicularly disposed between an opposing right member 26 and left member 28 of the rectangular base 22. A pair of "L" shaped supports 32 and 34 are rigidly fixed to the top of the cross brace 24. A rod 40 passes through openings 33 and 35 in the "L" shaped supports.

A movable sub-frame 50 includes a right lever 52 and a left lever 54, attached to opposite ends of the rod 40, thereby permitting pivotal movement of the levers 52 and 54 about a horizontal first axis of rotation A1. A "U" shaped member 56 attached between the levers 52 and 53 provides structural stability to the sub-frame 50 and requires the levers 52 and 54 to pivot in tandem about the first axis of rotation A1. A cross brace 58 further reinforces the rigidity and structural stability of the sub-frame 50. A cylindrical post 60 is affixed to the top of the "U" shaped member 56. Standard iron weights 59 may be stacked in increments around the post 60 to provide incremental mass for resisting pivotal movement about axis A1 (see also FIGS. 6 and 7).

Figure 4:
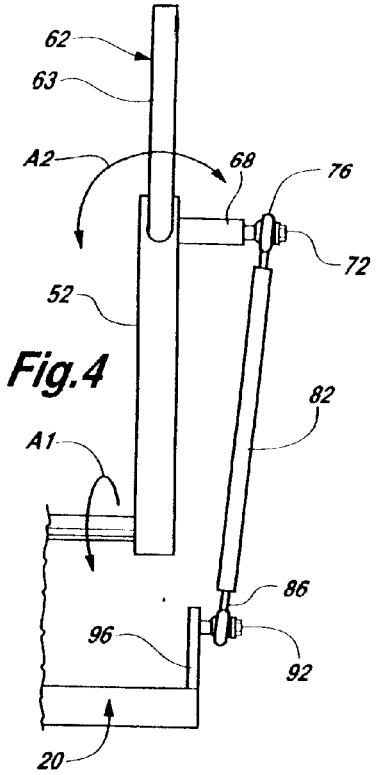
FIG. 4 is a partial rear view of the exercise device of FIG. 1, illustrating a first position in the use thereof.
Figure 5:
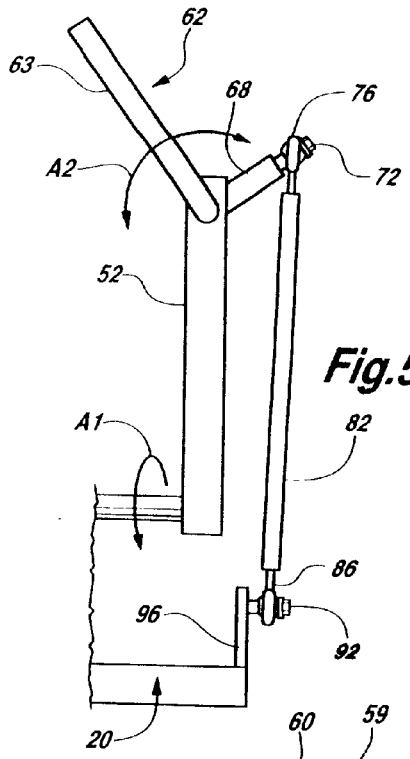
FIG. 5 is a partial rear view of the exercise device of FIG. 1, illustrating a second position in the use thereof.
Figure 7:
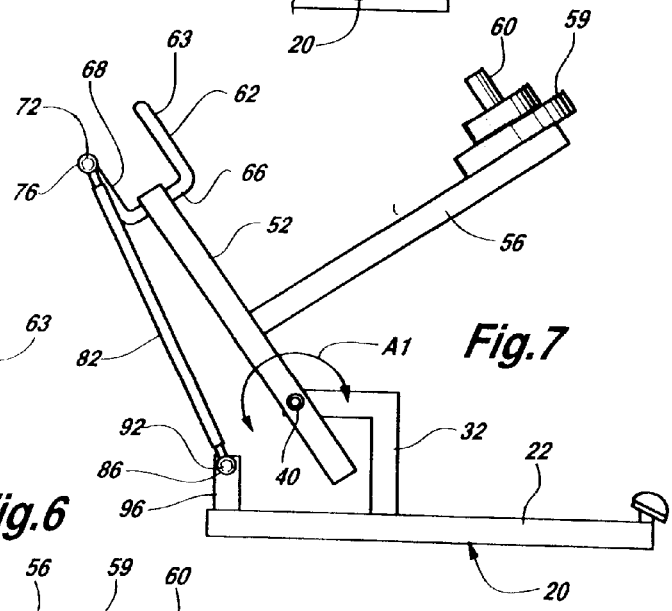
FIG. 7 is a partial side view of the exercise device of FIG. 1, illustrating a second position in the use thereof.
Figure 6:
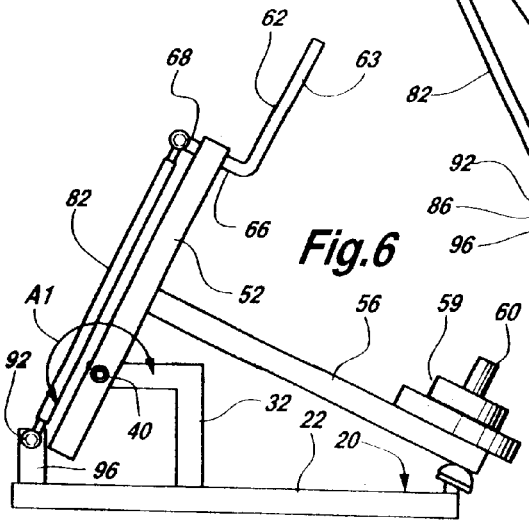
FIG. 6 is a partial side view of the exercise device of FIG. 1, illustrating a first position in the use thereof.

Referring to FIGS. 4 and 5 in addition to FIG. 1, there are movably attached to the distal end of each lever 52 and 54 identical double "L" shaped handles 62 and 64. Although not shown in FIGS. 4–7, the lever 54 and the handle 64 and their associated components are mirror images of the lever 52 and the handle 62. The handle 62 includes an elongated tubular grip section 63 for grasping by the exerciser's hand. The handle 62 further includes a shorter cylindrical section 66 attached at a 90° angle to the grip section 63 and passing through an opening in the distal end of the lever 52, thereby allowing for pivotal movement of the grip 63 about a second axis of rotation A2. The companion handle 64 includes corresponding elements allowing for pivotal movement of grip 65 about a third axis A3.

The cylindrical section 66 is connected to a second leg 68 of the double "L" shaped handle 62. Similarly, companion double "L" shaped handle 64 includes a second leg 69 attached to cylindrical section 67.

The distal end of the leg 68 of the double "L" shaped handle 62 includes a first ball connector 72. A mating first socket connector 76 is attached to the first end of linkage rod 82. A second socket connector 86 is attached to the opposite end of the linkage rod 82. The socket connector 86 receives a ball connector 92 that is attached to a bracket 96 that is in turn rigidly attached to the base member 22 of the support frame 20. In like manner, the distal end of the leg 69 of the double "L" shaped handle 64 includes a first ball connector 74. A mating first socket connector 78 is attached to the first end of the linkage rod 84. A second socket connector 88 is attached to the opposite end of linkage rod 84. The second socket connector 88 receives a ball connector 94 that is in turn attached to a bracket 98 that is rigidly attached to the base member 28 of the support frame 20. The seat 110 and the back 112 are attached to a support 120 that is in turn rigidly attached to the cross support 24 of the frame 20. The seat 110 and the back 112 are positioned between the grip handles 62 and 64 and the levers 52 and 54.

Figure 3:
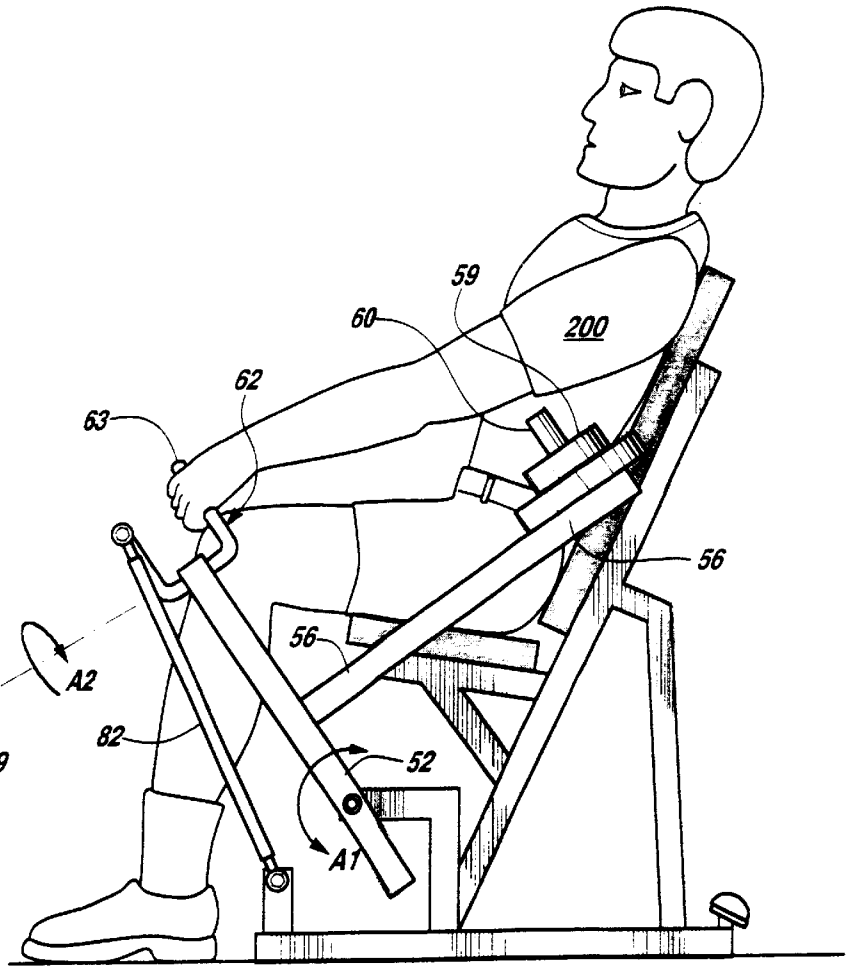
FIG. 3 is a side view of the exercise device of FIG. 1, illustrating a second position in the use thereof.
Figure 2:
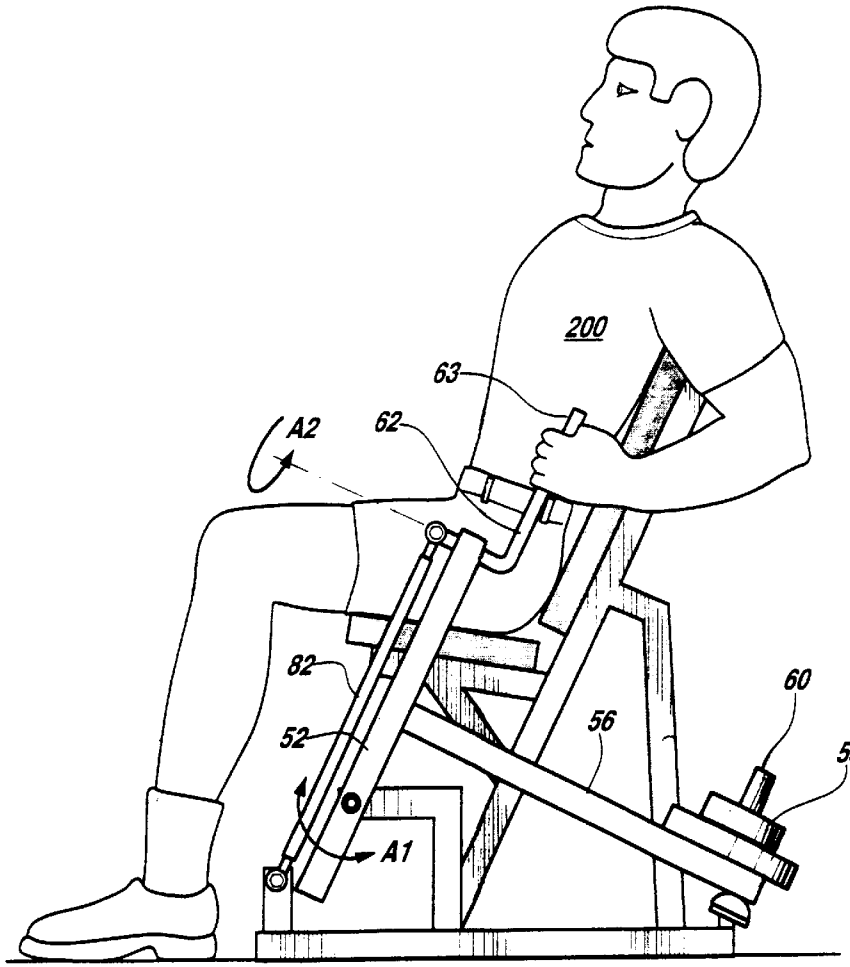
FIG. 2 is a side view of the exercise device of FIG. 1, illustrating a first position in the use thereof.

Referring to FIGS. 2 and 3, in operation, as force is applied by the exerciser 200 to the handle 62 and companion handle 64 (not shown), the lever 52 of the sub-frame 50 is pivoted forward about axis A1. Resistance to forward movement is provided by the mass of the weight stack 59. As is illustrated in FIGS. 3 through 7, as the lever 52 pivots about axis A1, the handle 62 is forced to pivot in a predetermined fixed relationship about axis A-2. The hands and forearms of the exerciser 200 undergo a pronation or supination movement as the grip handles 62 and 64 are pivoted about the axis A2 so as to converge and diverge when the levers are pivoted about the axis A1. The hands and forearms also move down and in as the levers are pivoted.

Referring now to FIGS. 8–11 therein is illustrated an alternate embodiment 180 wherein a pair of miter gears 186 and 188 are inserted in place of the linkage rod 82 and the connectors 72, 74, 76, 78, 86, 88, 92 and 94 of FIGS. 4–7. The below described elements designated by (') reference numerals replace those like numbered elements illustrated in FIG. 1–3 without the (') designation.

Figure 8:
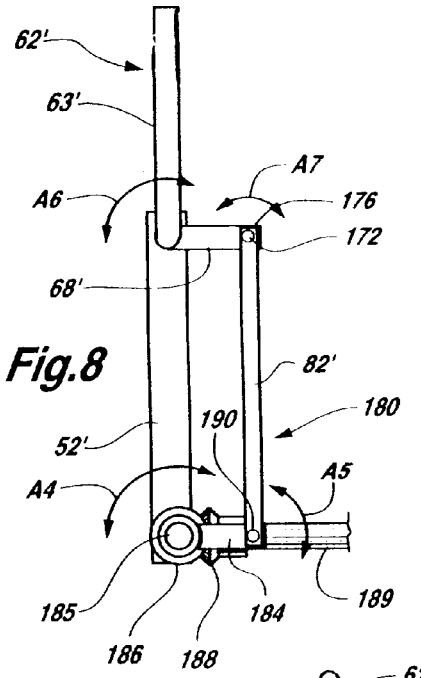
FIG. 8 is a partial rear view of a second embodiment of the exercise device of the present invention, illustrating a first position in the use thereof.
Figure 9:
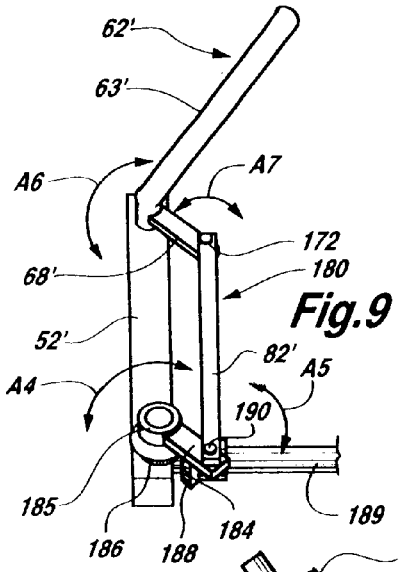
FIG. 9 is a partial rear view of the exercise device of FIG. 8 illustrating a second position in the use thereof.
Figure 11:
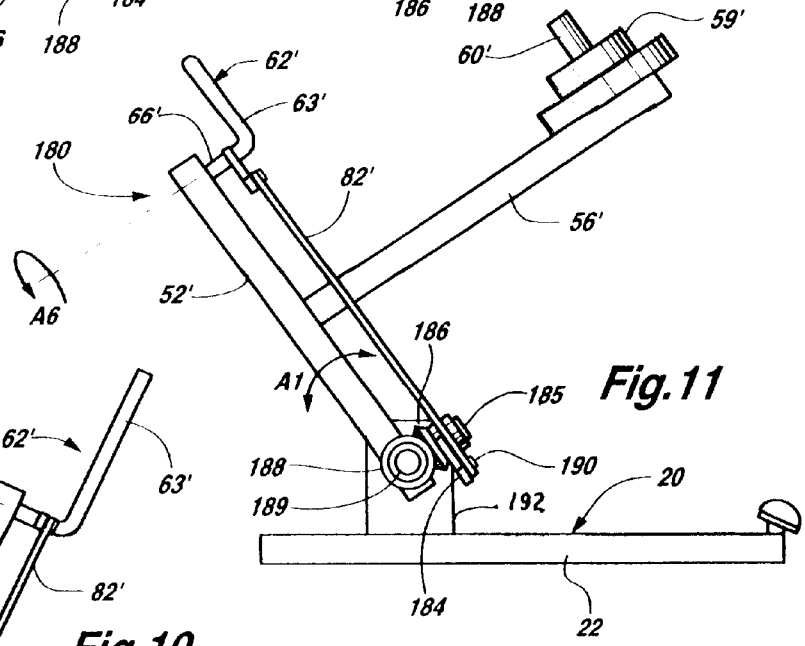
FIG. 11 is a partial side view of the exercise device of FIG. 8 illustrating a second position in the use thereof.
Figure 10:
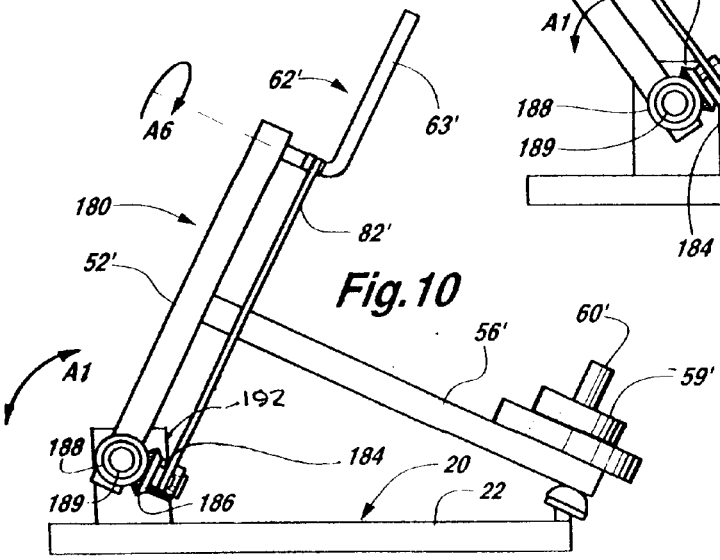
FIG. 10 is a partial side view of the exercise device of FIG. 8 illustrating a first position in the use thereof.

Referring to FIGS. 8 and 9 in addition to FIGS. 1–3, a pair of identical "L" shaped handles 62' and 64' (not shown) are movably attached to the distal ends of a lever 52' and a lever 54' (not shown). Although not shown in FIGS. 8–11, the lever 54' and the handle 64' and their associated components are mirror images of the lever 52' and the handle 62'.

Levers 52' and 54' are mounted at the proximal ends thereof to rotate on fixed axle 189. Fixed axle 189 is rigidly supported by mounting bracket 192. Located on the fixed axle 189 and adjacent to the lever 52' is a stationary miter gear 188 fixed to axle 189. A hub 185 is affixed to the proximal end of the lever 52' oriented 90° to the fixed axle 189. A rolling miter gear 186 is mounted on the hub 185 such that the rolling miter gear 186 is oriented 90° to the stationary miter gear 188. The stationary miter gear 188 and the rolling miter gear 186 include a 45° miter on their face and are commercially available from the Martin Company of Arlington, Tex. Attached to the rolling miter gear 186 is a bracket 184. As the rolling gear 186 rotates, the bracket 184 pivots about the hub 185 in an axis A4, in a plane perpendicular to the plane of axis A1.

A standard connector pin 190 connects the distal end of the bracket 184 with the first end of the connector rod 82', allowing pivotal movement of the bracket 184 about an axis of rotation A5 that is parallel to, but displaced from axis A4.

The handle 62' includes an elongated tubular grip section 63' for grasping with a hand. The handle 62' further includes a shorter cylindrical section 66' attached at a 90° angle to the grip section 63' and passing through an opening in the distal end of the lever 52' allowing for pivotal movement of the grip section 63' about an axis of rotation A6.

Connected to the cylindrical section 66', and perpendicular to the axis of the cylindrical section 66', is a bracket 68'. The distal end of the bracket 68' includes a standard pin connector 172 received in an opening 176 in linkage rod 82'. Pivotal movement of the linkage rod 82' is allowed about axis A7 in a plane parallel to, but displaced from, the plane of pivotal movement of handle 63'.

During operation of the second embodiment, as force is applied by the exerciser to the handle 62' and the companion handle 64' (not shown), the levers 52' and 54' of the sub-frame 50' are pivoted forward about axis A1. Resistance to forward movement is provided by the mass of the weight stack 59'. As is illustrated in FIGS. 8–11, as the lever 52' pivots about axis A1, the stationary gear 188 rotates rolling gear 186. The bracket 184 affixed to the gear 186 pivots about axis A4, perpendicular to axis A1 thereby forcing the linkage rod 82' to pivot about axis A5. The linkage rod 82' forces the bracket 68' to rotate about axis A6, thereby pivoting the handle 62' in a predetermined fixed relationship about axis A-6. The hands and forearms of the exerciser undergo a forced pronation or supination movement as the grip handle 62' pivots about the axis A6 when the lever 52' is pivoted about the axis A1.

Figures 12, 13, 14:
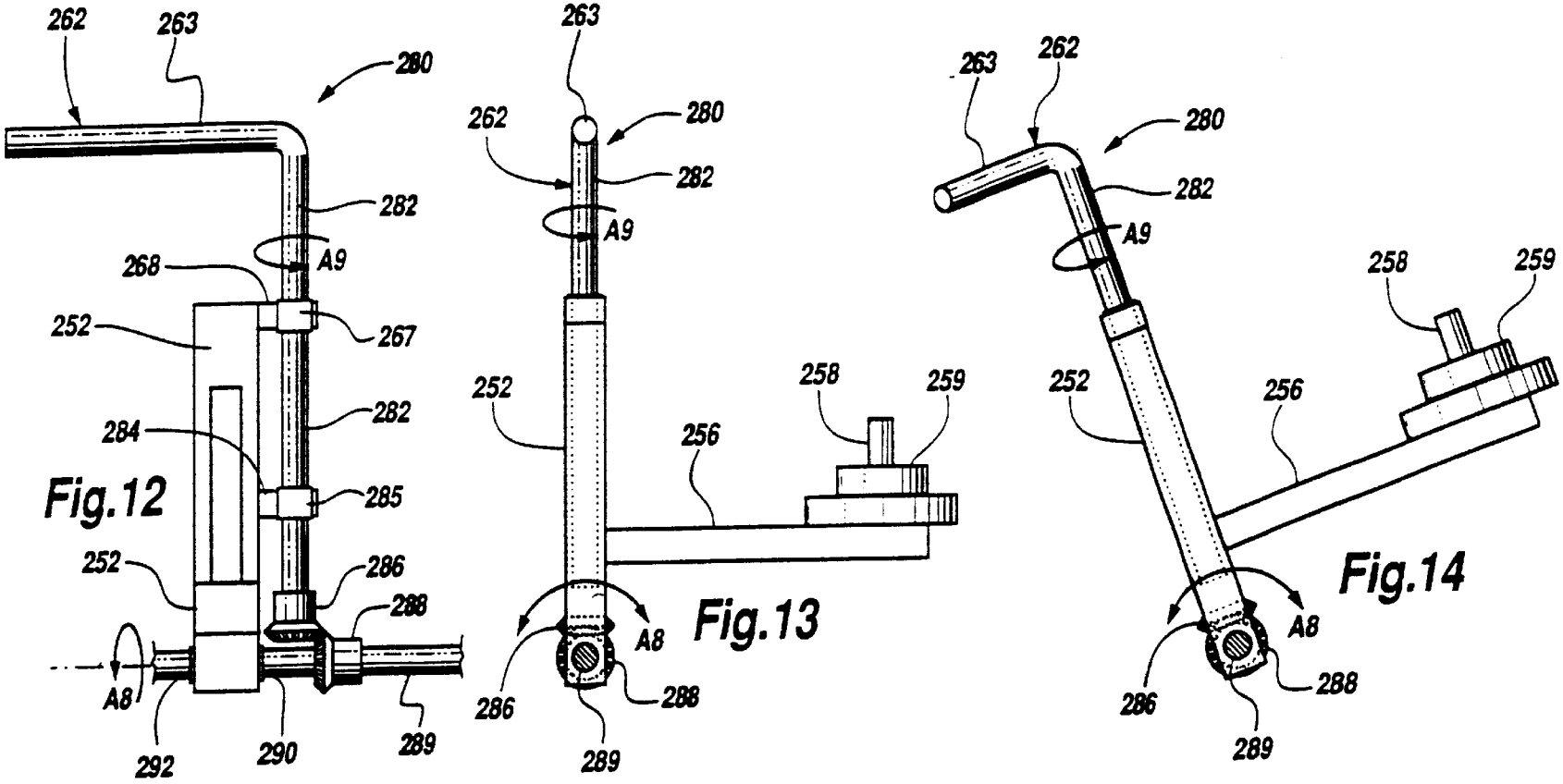
FIG. 12 is a partial front view of a third embodiment of the exercise device of the present invention illustrating a first position in the use thereof.
FIG. 13 is a partial side view of the exercise device of FIG. 12 illustrating a first position in the use thereof.
FIG. 14 is a partial side view of the exercise device of FIG. 12 illustrating a second position in the use thereof.

Referring now to FIGS. 12–14 therein is illustrated a third embodiment 280 of the present invention that provides for a modified hand and arm motion occurring as the hands and arms moved through the desired exercise range of motion. An "L" shaped handle 262 is movably attached to a lever 252 by means of brackets 268 and 284 and bearings 267 and 285. The handle 262 includes an elongated tubular grip section 263 for grasping with a hand. The handle 262 further includes a leg section 282 attached at a 90° angle to the grip section 263, said leg section 282 is disposed through the bearings 267 and 285 of brackets 268 and 284 providing for pivoting movement of the grip section 263 about an axis of rotation A9.

On the proximal end of the lever 252 is a cylindrical opening containing a pair of bearings 290 and 292. The lever 252 is pivotally mounted on a fixed axle 289 that passes through the bearings 290 and 292, thereby providing for a pivoting movement about an axis A8.

A rolling miter gear 286 is fixably mounted on the leg section 282 of the handle 262. Located on the fixed axle 289 and adjacent to the lever 252 is a stationary miter gear 288. The rolling miter gear 286 is oriented 90° to the stationary miter gear 288. The stationary miter gear 288 and the rolling miter gear 286 include 20° pressure angle gear teeth with a 45° bevel angle and are commercially available from the Martin Company of Arlington, Tex. Cylindrical post 258 is affixed to the top of member 256, which extends from lever 252. Standard iron weights may be stacked in increments around post 258 to provide incremental mass for resisting pivotal movement about axis A8.

During operation of the third embodiment, as force is applied by the exerciser 200 to the handle 262, the lever 252 is pivoted forward about axis A8. Resistance to forward movement is provided by the mass of the weight stack 259. As is illustrated in FIGS. 12–14, as the lever 252 pivots about axis A8, the stationary gear 288 forces rolling gear 286 to rotate about axis A9. The leg section 282 affixed to rolling gear 286 rotates with gear 286 thereby pivoting the grip handle 263 in a predetermined fixed relationship about the axis A9, perpendicular to axis A8. The hands and arms of the exerciser 200 undergo a forced movement as the grip handle 262 pivots about the axis A9 when the lever 252 is pivoted about the axis A8.

Figure 15:
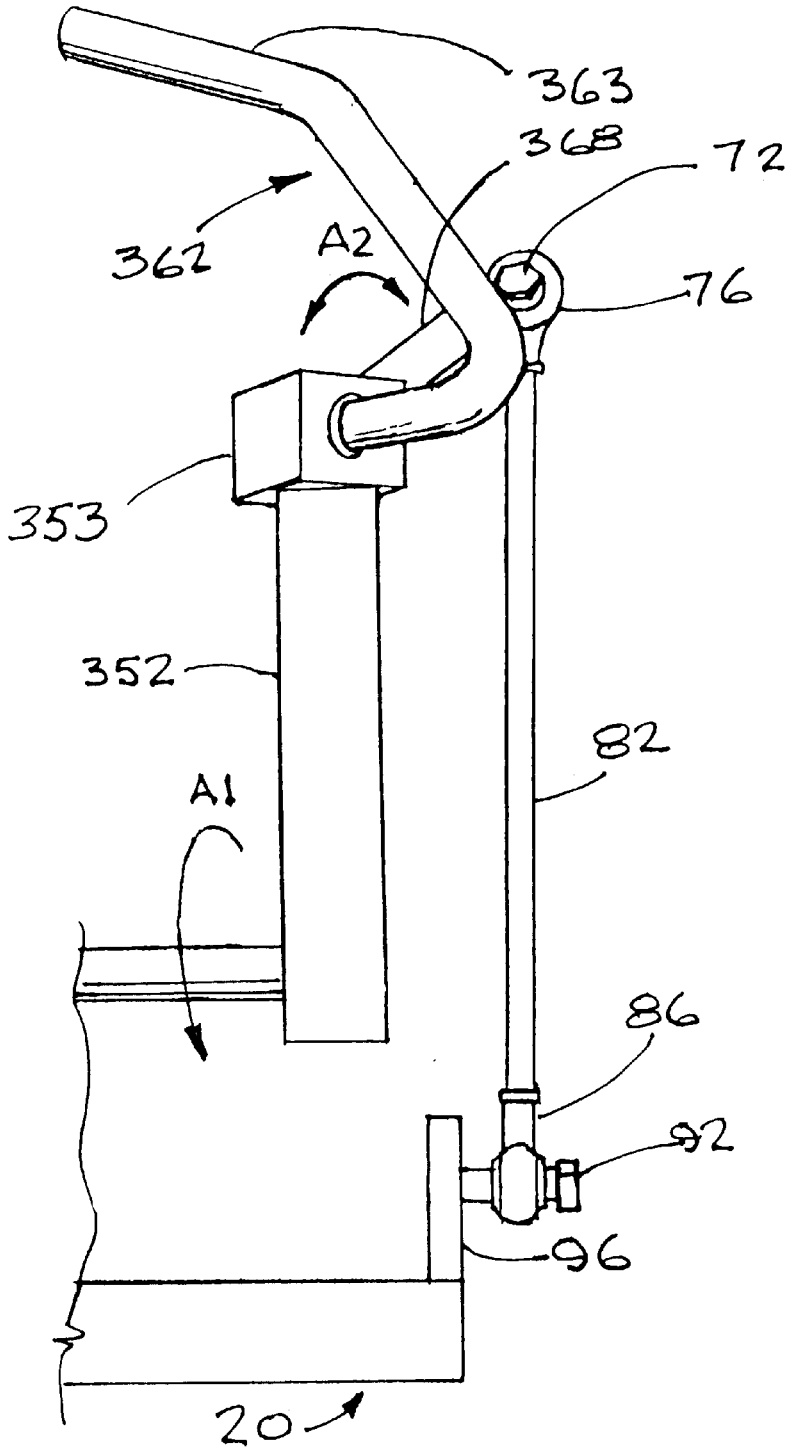
FIG. 15 is a partial auxiliary view, showing a exercise machine similar to FIG. 4 with an alternative handle arrangement.

FIG. 15 shows a partial auxiliary view, showing one side of a symmetrical exercise machine, similar to FIG. 4, but having an alternative handle arrangement. The proximal end of lever 352 is mounted to rotate about axis A1 in the same manner as lever 52 of FIG. 4. Handle 362 is mounted in skewed end member 353, at the distal end of lever 352, so that handle 362 rotates about axis A2 as lever 352 rotates about axis A1. It is notable that grip portion 363 is bent with respect to the "L" shaped portion of handle 363 so as to be in a position substantially perpendicular to the user's forearm but the shape of handle 362 is otherwise as described for handle 62 of FIG. 4. Skewed member 353 causes axis A2 to be inclined at an angle of as much as 30°–45° with respect to the user's forearm. Thus, the substantially perpendicular relationship of axis A2 to axis A1 shown and described in FIG. 4 can include angles approximately 45° off perpendicular and still be effective for the purposes of the present invention. Leg 368 extends from handle 362 and connects to linkage rod 82 by means of ball connector 72 and socket connector 76. The opposite end of linkage rod 82 is connected to bracket 96 and frame 290 by socket and ball connectors 86 and 92. This connection causes handle 362 to pivot on axis A2 as lever 352 rotates about axis A1.

Figure 16:
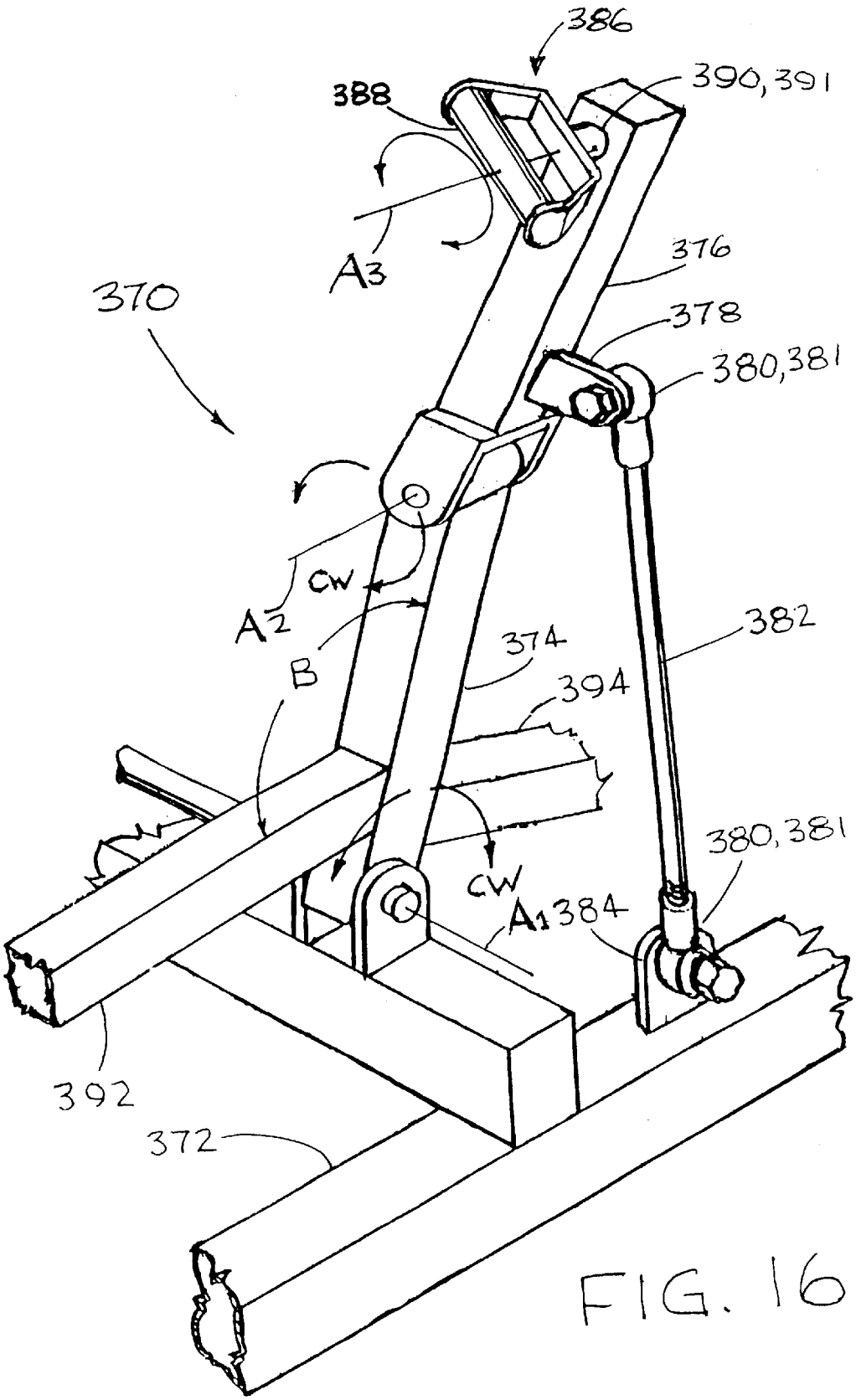
FIG. 16 is a partial auxiliary view, showing an exercise machine similar to FIG. 4, but using the handle arrangement of the present inventions.

FIG. 16 is a partial auxiliary view, showing the right hand side of a symmetrical exercise machine 370 resembling previously disclosed machines in some respects. Unlike those of previous disclosures however, exercise machine 370 is configured to emulate the feel, effect and results of working with dumbbells. Base frame 372 provides the requisite supporting structure. Axis A1 is transversely mounted on base frame 372 and the proximal end of lever 374 is mounted to rotate about axis A1, in the manner previously disclosed. Handle extension 376 is mounted at the distal end of lever 374, where it rotates about axis A2. Axes A1 and A2 are set in a substantially perpendicular relationship to one another but, as has previously been disclosed, the relationship can include angles approximately 45° off perpendicular and still be effective for the purposes of the present invention.

Bracket 378 extends from handle extension 376 and connects to linkage rod 382 by means of ball connector 380 and socket connector 381. The opposite end of linkage rod 382 is connected to bracket 384 and frame 372 by another set of socket and ball connectors 380 and 381. As lever 374 rotates in a clockwise direction (CW) about axis A1, this connection causes handle extension 376 to pivot in a counter-clockwise direction (CCW) about axis A2. Handle 386 includes grip portion 388 at one end and pivot shaft 390 at the other end, centered on and aligned perpendicularly to grip portion 388. Pivot shaft 390 extends through pivot bearing 391 at the distal end of handle extension 376 and is connected so that handle 386 is free to rotate about axis A3. When exercise machine 370 is in use, the user's hand grasps grip portion 388 and handle 386 pivots about axis A3 to allow a natural alignment of grip portion 388 with the user's hand. In this position, the user's forearm is parallel to and substantially in alignment with the user's forearm.

In providing adjustable resistance to "bench" press type exercise movements, lever 374 rotates about axis A1 in a (CW) clockwise direction. Weight member 392 extends from lever 374 to receive weights for providing adjustable exercise resistance. In addition, the angle "B" may be varied to shift the point of maximum resistance within the range of movement. As an alternative, member 392 may be connected to a cam varied resistance device which alters the effective moment arm of the resisting weight. In any case, as the user's arms extend in the exercise, the hands follow a converging path. Throughout the exercise, the hands and forearms are free to pronate or supinate to a natural position, or as the user wishes.

Should the machine be adapted to provide for a "rowing" type exercise, weight member 392 would be replaced with alternate weight member 394, extending in the opposite direction. In this scenario, lever 374 rotates in a counter-clockwise direction (CCW) about axis A1 as the rowing movement is made, and grip portions 388 follow divergent paths. This simulates a rowing exercise as performed with dumbbells or, for that matter, the performance of an actual rowing motion.

Figure 17:
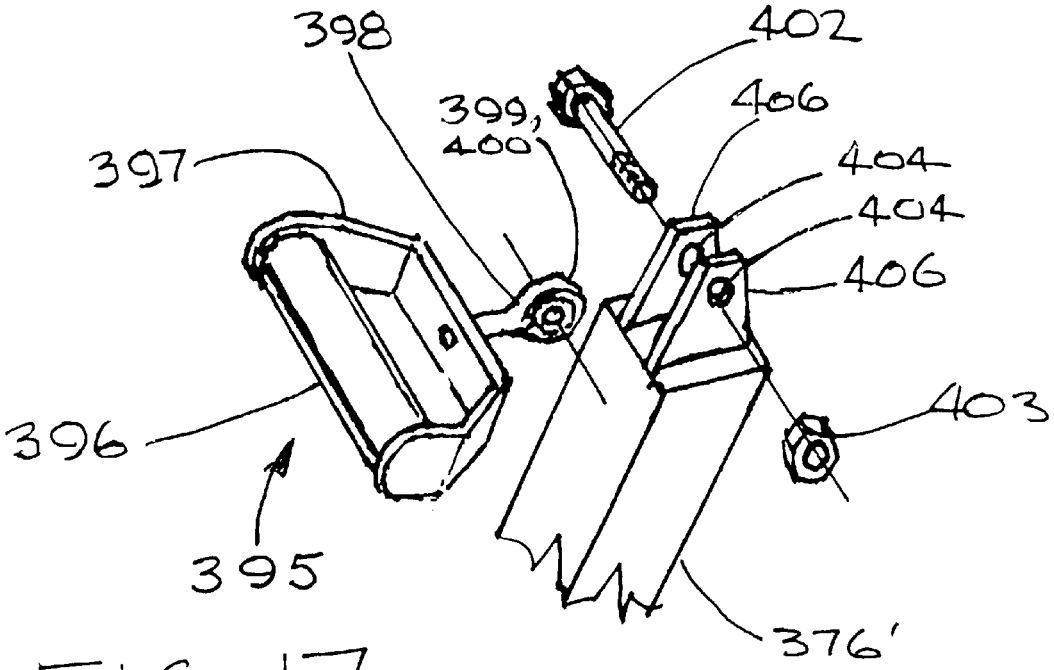
FIG. 17 shows an alternative handle arrangement for possible use with the embodiment of FIG. 16.

FIG. 17 illustrates an alternative pivotal attachment of handle 395 to handle extension 376'. Handle extension 376' is otherwise interchangeable with handle extension 376 of FIG. 16. Handle 395 includes gripping portion 396 and bracket portion 397. At the center of bracket 397 is mounted ball and socket rod end bearing 398. Ball 399 of rod end bearing 398 includes a central connecting hole 400, through which connecting bolt 402 passes on assembly. Connecting bolt 402 also passes through holes 404 in clevis brackets 406 where it is held firmly in place by nut 403. Thus assembled, handle 395 allows handgrip 396 to swivel with ball 399 so as to pronate and supinate as is natural, or as the user desires. This arrangement has the further advantage of reversible, so that the machine may be used for either pressing or rowing type exercises, by flipping handle 395 over to the opposite side of handle extension 376'.

Figure 18:
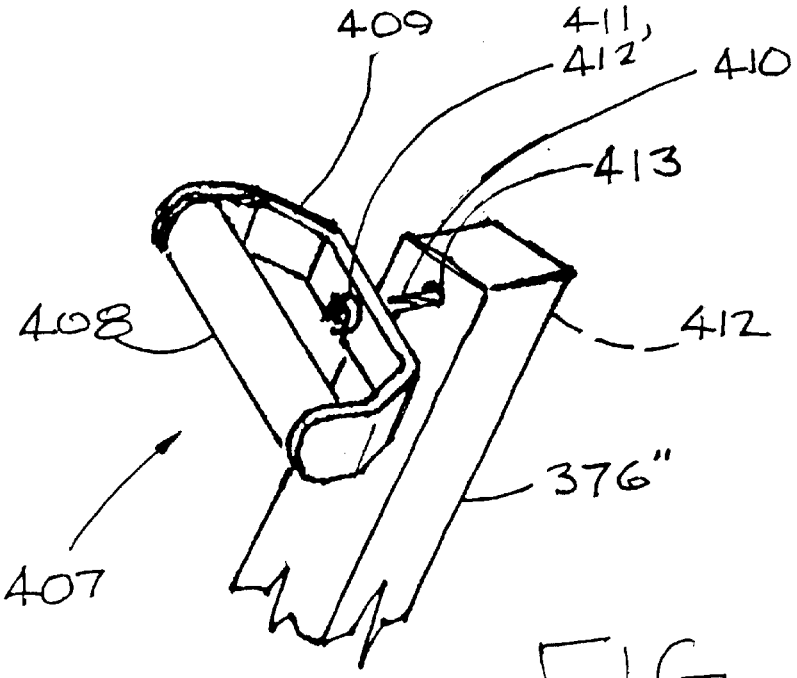
FIG. 18 shows a second alternative handle arrangement for possible use with the embodiment of FIG. 16.

FIG. 18 illustrates a second pivotal attachment of handle 407 to handle extension 376'. Handle extension 376" is otherwise interchangeable with handle extension 376 of FIG. 16. Handle 407 includes gripping portion 408 and bracket portion 409. Bracket portion 409 includes a central connecting hole 411, for receiving connecting cable 410. Connecting cable 410 also passes through connecting hole 413 in distal end of handle extension 376", where it is held firmly in place by swaged fittings 412. Thus assembled, handle 407 allows the user's hand to pronate and supinate in a natural manner, or as the user desires.

Figure 19:
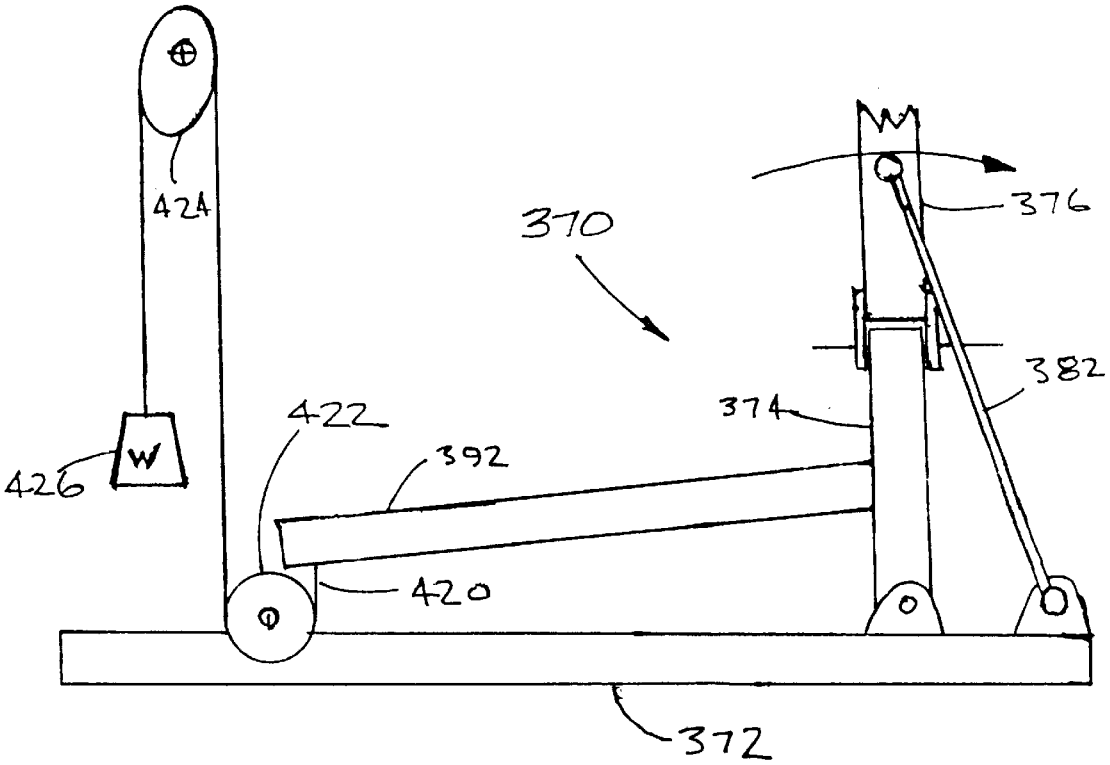
FIG. 19 shows one example, well known in the art, of achieving a variable resistance for exercise machines incorporating the present invention.

FIG. 19 shows a schematic arrangement of a variable resistance for exercise machine 370 wherein flexible cable 420 depends from member 392 and makes a directional change of 180° in passing around pulley 422. Pulleys 422 and 424 are mounted to base frame 372 on roller bearings so as to be free to rotate. Flexible cable 420 then passes over non-circular, eccentrically mounted pulley 424. The shape of pulley 424 is specifically designed to vary the moment arm at which lifting weight 426 acts, so as to increase or decrease the load on cable 420 as is appropriate to the optimum profile for the specific exercise.

It is to be understood that the elements of the above-described invention may be used in any number of configurations for exercise machines including but not limited to push or pull motions in bench press machines, rowing machines, pull down machines and decline press machines. Although the preferred and alternative embodiments of the invention have been shown in the accompanying drawings and described in the Detailed Description, it will be understood that the invention is not limited to the embodiment disclosed but is capable of numerous modifications without departing from the scope of the claimed inventions.

The embodiments shown and described above are exemplary. Many details are often found in the art and, therefore, many such details are neither shown nor described. It is not claimed that all of the details, parts, elements, or steps described and shown were invented herein. Even though numerous characteristics and advantages of the present inventions have been described in the drawings and accompanying text, the description is illustrative only, and changes may be made in the detail, especially in matters of shape, size, and arrangement of the parts within the principles of the inventions to the full extent indicated by the broad meaning of the terms of the attached claims.

The restrictive description and drawings of the specific examples above do not point out what an infringement of this patent would be, but are to provide at least one explanation of how to use and make the inventions. The limits of the inventions and the bounds of the patent protection are measured by and defined in the following claims.

I claim:

1. Apparatus for exercising the forearms and upper arms, in the manner of dumbbells, permitting elective pronation and supination movements of the hands in combination with converging and diverging arm movements, the apparatus comprising:

a frame including a horizontal first pivotal axis;

at least one lever having first and second ends wherein the first end is connected for pivotal movement about the first pivotal axis;

means operatively connected to the at least one lever for resisting pivotal movement thereof about the first pivotal axis;

a handle extension having first and second ends wherein the first end is connected to the at least one lever, at the second end thereof, for pivotal movement about a second pivotal axis, the second pivotal axis being inclined at an angle of between approximately 45° and 135° with respect to the first pivotal axis;

a linkage rod having first and second ends;

a first socket connector attached to the handle extension;

a first ball connector received in the first socket connector and attached to the first end of the linkage rod;

a second socket connector attached to the frame of the exercise device;

a second ball connector received in the second socket connector and attached to the second end of the linkage rod, so that the handle extension pivots about the second pivotal axis in a predetermined relationship relative to the at least one lever as it pivots about the first pivotal axis; and a handle having a longitudinal axis substantially parallel to the second pivotal axis, a gripping end centered on, and perpendicular to the longitudinal axis, and an opposite end, pivotally connected to the handle extension at the second end thereof, so that the handle is free to rotate about the longitudinal axis.

2. Apparatus for exercising the forearms and upper arms, in the manner of dumbbells, permitting elective pronation and supination movements of the hands in combination with converging and diverging arm movements, the apparatus comprising:

a frame including a horizontal first pivotal axis;

at least one lever having first and second ends wherein the first end is connected for pivotal movement about the first pivotal axis;

means operatively connected to the at least one lever for resisting pivotal movement thereof about the first pivotal axis;

a handle extension having first and second ends wherein the first end is connected to the at least one lever, at the second end thereof, for pivotal movement about a second pivotal axis, the second pivotal axis being inclined at an angle of between approximately 45° and 135° with respect to the first pivotal axis;

a linkage rod having first and second ends;

the handle extension including a first pin receiving connector;

a first pin connection attached to the first end of the linkage rod and received in the first pin receiving connector;

the frame of the exercise device including a second pin receiving connector;

a second pin connection attached to the second end of the linkage rod and received in the second pin receiving connector, so that the handle extension pivots about the second pivotal axis in a predetermined relationship relative to the at least one lever as it pivots about the first pivotal axis; and a handle having a longitudinal axis substantially parallel to the second pivotal axis, a gripping end centered on, and perpendicular to the longitudinal axis, and an opposite end, pivotally connected to the handle extension at the second end thereof, so that the handle is free to rotate about the longitudinal axis.

3. Apparatus for exercising the forearms and upper arms, in the manner of dumbbells, permitting elective pronation and supination movements of the hands in combination with converging and diverging arm movements, the apparatus comprising:

a frame including a horizontal first pivotal axis;

at least one lever having first and second ends wherein the first end is connected for pivotal movement about the first pivotal axis;

means operatively connected to the at least one lever for resisting pivotal movement thereof about the first pivotal axis;

a handle extension having first and second ends wherein the first end is connected to the at least one lever, at the second end thereof, for pivotal movement about a second pivotal axis, the second pivotal axis being inclined at an angle of between approximately 45° and 135° with respect to the first pivotal axis;

a linkage rod having first and second ends;

a first ball connector attached to the handle extension;

a first socket connector attached to the first end of the linkage rod and receiving said first ball connector;

a second ball connector attached to the frame of the exercise device;

a second socket connector attached to the second end of the linkage rod and receiving said second ball connector, so that the handle extension pivots about the second pivotal axis in a predetermined relationship relative to the at least one lever as it pivots about the first pivotal axis; and a handle having a longitudinal axis substantially parallel to the second pivotal axis, a gripping end centered on, and perpendicular to the longitudinal axis, and an opposite end, pivotally connected to the handle extension at the second end thereof, so that the handle is free to rotate about the longitudinal axis.

4. An exercise device comprising;

a frame including a first pivotal axis;

at least one lever having first and second ends;

means supporting the at least one lever, at the first end thereof, on the frame for pivotal movement about the first pivotal axis;

means operatively connected to the at least one lever for resisting pivotal movement thereof about the first pivotal axis;

a handle extension having first and second ends and a first longitudinal axis extending therebetween;

a linkage rod having first and second ends;

a first ball connector attached to the handle extension;

a first socket connector attached to the first end of the linkage rod and receiving said first ball connector;

a second ball connector attached to the frame of the exercise device;

a second socket connector attached to the second end of the linkage rod and receiving said second ball connector, so that the handle extension pivots about the second pivotal axis in a predetermined relationship relative to the at least one lever as it pivots about the first pivotal axis; and a handle having a second longitudinal axis, a gripping end centered on, and perpendicular to the second longitudinal axis, the handle being pivotally connected to the handle extension, at the second end thereof, so that the second longitudinal axis lies substantially in the plane established by the second pivotal axis together with the first longitudinal axis, the handle being free to rotate about the second longitudinal axis.

5. An exercise machine for providing selected resistance through a range of motion comprising;

a frame including a horizontal first pivotal axis;

a seat mounted on said frame;

a backrest mounted rearwardly of said seat;

a pair of substantially parallel first members pivotally mounted to said frame for rotation against the selected resistance about said horizontal first pivotal axis, said first members each including one of a pair of spaced apart, substantially parallel and angularly oriented second pivotal axes lying substantially perpendicular to said horizontal first axis;

a pair of second members each having a mounting end pivotally connected to one of said first members, for rotation about said second pivotal axis and an outer end;

a linkage rod having first and second ends;

a first ball connector attached to each said second member;

a first socket connector attached to the first end of said linkage rod and receiving said first ball connector;

a second ball connector attached to the frame of the exercise device;

a second socket connector attached to the second end of said linkage rod and receiving said second ball connector, so that the second members pivot about the second pivotal axis as the first members are caused to pivot about the first pivotal axis so that the outer ends converge along predetermined curved paths as the first members pivot from a first position to a second position; and a handle connected to each of the second members, at the outer ends thereof, for free rotation about a third axis, the handle being centered on and perpendicular to the respective third axis and the third axes being substantially parallel to the respective second pivotal axes.

* * * * *